US007718010B2

(12) United States Patent
Faure et al.

(10) Patent No.: US 7,718,010 B2
(45) Date of Patent: May 18, 2010

(54) METHOD FOR TREATING A SURFACE WITH A TREATMENT GEL, AND TREATMENT GEL

(75) Inventors: Sylvain Faure, Pertuis (FR); Bruno Fournel, Vinon sur Verdon (FR); Paul Fuentes, Manosque (FR); Yvan Lallot, Manosque (FR)

(73) Assignees: Commissariat a L'Energie Atomique, Paris (FR); Compagnie Generale des Matieres Nucleaires, Velizy Villacoublay (FR)

( * ) Notice: Subject to any disclaimer, the term of this patent is extended or adjusted under 35 U.S.C. 154(b) by 0 days.

(21) Appl. No.: 11/200,700

(22) Filed: Aug. 9, 2005

(65) Prior Publication Data

US 2006/0032518 A1 Feb. 16, 2006

Related U.S. Application Data

(62) Division of application No. 10/483,839, filed as application No. PCT/FR02/02509 on Jul. 15, 2002.

(30) Foreign Application Priority Data

Jul. 17, 2001 (FR) ..... 01 09520

(51) Int. Cl.
*B08B 7/00* (2006.01)

(52) U.S. Cl. ..... 134/6; 134/10; 134/21; 134/22.1; 134/22.11; 134/22.13; 134/26; 134/36; 134/42; 510/180; 510/181; 510/243; 510/253; 510/269; 510/403; 510/511

(58) Field of Classification Search ..... 510/180, 510/181, 243, 253, 269, 403, 511, 263; 134/6, 134/21, 10, 22.1, 22.11, 22.13, 36, 26, 42
See application file for complete search history.

(56) References Cited

U.S. PATENT DOCUMENTS

| | | | | |
|---|---|---|---|---|
| 3,578,499 | A * | 5/1971 | Crotty et al. | 134/4 |
| 4,365,516 | A | 12/1982 | Molina | |
| 5,264,010 | A | 11/1993 | Brancaleoni et al. | |
| 5,858,037 | A * | 1/1999 | Sukumaran Jayan et al. | 51/309 |
| 6,203,624 | B1 * | 3/2001 | Bargues et al. | 134/3 |
| 6,455,751 | B1 * | 9/2002 | Hoffman et al. | 588/320 |
| 6,475,296 | B1 | 11/2002 | Gauchon et al. | |

(Continued)

FOREIGN PATENT DOCUMENTS

| | | |
|---|---|---|
| EP | 0589781 | 3/1994 |

(Continued)

*Primary Examiner*—Sharidan Carrillo
(74) *Attorney, Agent, or Firm*—Nixon Peabody LLP

(57) ABSTRACT

The present invention related to a method for treating a surface with a gel, as well as to a treatment gel.

The treatment may be a decontamination, etching or surface degreasing treatment, for example.

The method comprises in this order, the following steps: applying the treatment gel on the surface to be treated, maintaining the treatment gel on the surface to be treated at a temperature and relative humidity such that the gel dries by breaking up and that it has the time to treat the surface before forming a dry and solid residue, and removing the dry and solid residue from the treated surface by suction or brushing.

The gel comprises a viscosing agent, a treatment agent and optional an oxidizing agent.

20 Claims, 4 Drawing Sheets

U.S. PATENT DOCUMENTS

| | | | | |
|---|---|---|---|---|
| 6,605,158 | B1 * | 8/2003 | Martin | 134/10 |
| 6,689,226 | B1 * | 2/2004 | Cheung et al. | 134/41 |
| 2001/0051757 | A1 * | 12/2001 | Rouleau et al. | 585/481 |
| 2004/0175505 | A1 | 9/2004 | Faure et al. | |

FOREIGN PATENT DOCUMENTS

| | | | |
|---|---|---|---|
| FR | 2380624 | | 8/1978 |
| FR | 2656949 | | 12/1991 |
| JP | 59025982 | A | 2/1984 |
| WO | WO97/35323 | * | 9/1997 |
| WO | WO01/22431 | * | 3/2001 |

* cited by examiner

METHOD FOR TREATING A SURFACE WITH A TREATMENT GEL, AND TREATMENT GEL

CROSS-REFERENCE TO RELATED APPLICATION

This divisional application claims priority based on co-pending U.S. patent application Ser. No. 10/483,839, entitled "METHOD FOR TREATING A SURFACE WITH A TREATMENT GEL, AND TREATMENT GEL" filed Jan. 14, 2004, which claims priority to international patent application no. PCT/FR02/02509, filed Jul. 15, 2004, entitled, "Method For Treating a Surface With a Treatment Gel, and Treatment Gel" by Sylvain Faure, Bruno Fournel, Paul Furntes and Yvan Lallot, which claims priority of French Application No. 01 09520, filed on Jul. 17, 2001, and which was not published in English.

TECHNICAL FIELD

The present invention relates to a method for treating a surface with a gel, as well as to a treatment gel which may be used in such a method.

The treatment may for example be a radioactive or organic decontamination treatment, for example, an etching or a surface degreasing treatment.

It may be used on all kinds of surfaces to be treated, such as metal surfaces, plastic surfaces, glassy material surfaces, etc.

STATE OF THE PRIOR ART

Prior art gels do not dry or dry over several tens of hours and should all be removed after a few hours by rinsing with water. By rinsing, the action of the gel on the wall may also be interrupted and the action period of the gel may be controlled.

Rinsing has the drawback of generating liquid effluents of the order of 10 L of water per kg of gel used. These decontamination effluents when dealing with radioactive decontamination are treated in existing facilities for processing nuclear materials. This therefore imposes extensive investigations on the handling of such effluents and on their impact as regards the processing circuits of the facilities. In addition, such gels which must be rinsed should not be used for treating surfaces of facilities, which should not be flooded.

DESCRIPTION OF THE INVENTION

Specifically, the object of the present invention is to provide a method for treating a surface with a gel, as well as a treatment gel which may be used in such a method, which overcomes the aforementioned drawbacks of the prior art.

The treatment method comprises the following steps in this order:

- applying the treatment gel on the surface to be treated,
- maintaining the treatment gel on the surface to be treated at a temperature and relative humidity such that the gel dries and that it has the time of treating the surface before forming a dry and solid residue, and
- removing the dry and solid residue from the treated surface.

Preferably, according to the invention, the gel dries by breaking up.

The advantages of such a treatment, a so-called "suckable" gel treatment, as compared with prior art treatments, are numerous. First, it has the advantages of gel treatments. For example, when decontaminating on-site radioactive facilities, the projections of aqueous solutions producing large amounts of radioactive effluents may be avoided for a limited efficiency owing to the short contact time with the parts.

Next, the conventional rinsing operation of the gel with water or another liquid may be avoided, and hence no liquid effluent to be treated subsequently, is produced. This causes a reduction in the amount of effluents and a simplification in terms of an overall procedure for treating e.g. decontamination.

According to the invention, the treatment gel advantageously consists of a colloidal solution comprising:

- 5 to 25% by weight of an inorganic viscosing agent or a mixture of inorganic viscosing agents based on the weight of the gel,
- 0.1 to 7 mol/l, preferably from 0.5 to 4 mol/l, of an active treatment agent, and
- optionally from 0.05 to 1 mol/l of an oxidizing agent with a normal oxidation-reduction potential $E_0$ larger than 1.4 V in a strong acid medium or the reduced form of this oxidizing agent.

Concentrations are expressed in moles per liter of gel in the present text.

The inorganic or mineral viscosing agent may for example be based on silica or on a mixture of silicas. Preferably, according to the invention, silica is in a concentration of 5 to 15% by weight of the gel in order to ensure drying of the gel at a temperature between 20° C. and 30° C. and at a relative humidity between 20 and 70% on average within 2 to 5 hours. This silica may be hydrophilic, hydrophobic, acid or basic, such as Tixosil 73 (trade name) silica marketed by Rhodia.

Among acid silicas, pyrogenated silicas, "Cab-O-Sil" M5, H5 or EH5 (trade names) marketed by CABOT and pyrogenated silicas marketed by DEGUSSA under the name of AEROSIL (trade names) may notably be mentioned. Among pyrogenated silicas, AEROSIL 380 (trade name) silica with a surface area of 380 $m^2/g$ will be preferred, which provides maximum viscosing properties for a minimum mineral load.

The silica used may also be a so-called precipitated silica obtained for example by wet mixing a sodium silicate solution and an acid. Preferred precipitated silicas are marketed by DEGUSSA under the name of SIPERNAT 22 LS and FK 310 (trade names).

Advantageously, according to the invention, the viscosing agent is a mixture of both aforementioned types of silicas, pyrogenated and precipitated silicas. In this case, the mixture of silicas is preferably in a concentration from 5 to 10 weight percent of the gel, in order to ensure drying of the gel at a temperature between 20° C. and 30° C. and at a relative humidity between 20 and 70% on average within 2 to 5 hours. Indeed, such a mixture unexpectedly influences the drying of the gel and the grain size of the obtained residue.

Indeed, the dry gel comes in the form of particles with a controlled size from 0.1 to 2 mm, notably by means of the aforementioned compositions of the present invention.

For example, by adding 0.5% by weight of a precipitated silica FK 310 (trade names) to a gel with 8% of AEROSIL 380 (trade name) silica, the grain size of the dry residue is increased and this leads to residues of millimetric size facilitating removal or recovery by brushing or suction.

The mineral viscosing agent may also for example be based on alumina $Al_2O_3$, obtained through hydrolysis at high temperature for example. Preferably, the alumina is in a concentration from 10 to 25 weight % in the gel in order to ensure drying of the gel at a temperature between 20° C. and 30° C. and at a relative humidity between 20 and 70% within 2 to 3 hours. As an example, the product sold by DEGUSSA under the trade name "Alumina C" may be mentioned.

The active treatment agent may be an acid or a mixture of acids, preferably selected from hydrochloric acid, nitric acid, sulfuric acid and phosphoric acid. The acid is preferably present in a concentration from 0.1 to 7 mol/l, more preferably from 0.5 to 4 mol/l, in order to ensure drying of the gel at a temperature between 20° C. and 30° C. and at a relative humidity between 20 and 70% on average within 2 to 5 hours.

For this type of acid gel, the inorganic viscosing agent is preferably silica or a mixture of silicas.

The treatment gel according to the invention may also contain as an active treatment agent, a base, preferably a mineral base, preferably selected from caustic soda, potash, or mixtures thereof.

Advantageously, the base is present in a concentration less than 2 mol/l, preferably between 0.5 and 2 mol/l, more preferably between 1 and 2 mol/l, in order to ensure drying of the gel at a temperature between 20° C. and 30° C. and at a relative humidity between 20 and 70% on average within 2 to 5 hours.

For this type of alkaline gel, the inorganic viscosing agent is preferably alumina.

Lastly, the gel of the invention may contain an oxidizing agent which has a normal oxidation-reduction potential larger than 1,400 mV in a strong acid medium, i.e. a higher oxidizing power than that of permanganate. As an example, such oxidizing agents may be Ce (IV), Co (III) and Ag (II).

The oxidizing agents, among which cerium IV is preferred, are generally associated with a mineral acid, such as preferably nitric acid in a moderate concentration less than 2 mol/l and allowing for a rapid drying of the gel. Cerium is generally introduced as electrogenerated cerium (IV) nitrate, $Ce(NO_3)_4$, or diammonium hexanitrate-cerate $(NH_4)_2Ce(NO_3)_6$.

Thus, a typical example of an oxidizing decontamination gel according to the invention, consists of a colloidal solution comprising 0.1 to 0.5 mol/l of $Ce(NO_3)_4$ or $(NH_4)_2Ce(NO_3)_6$, from 0.5 to 2 mol/l of nitric acid and 5 to 15% by weight of silica.

The gels of the invention may easily be prepared at room temperature by adding to an aqueous solution, the mineral gelifying agent which preferably has a high specific area for example larger than 100 $m^2/g$. A viscosity equal to at least 350 mPa.s and a viscosity recovery time less than one second are preferred so that the gel may be sprayed either from a distance or not, onto the surface to be treated without flowing.

The object achieved by the present invention therefore also consists in providing gels with an action time controlled by a rapid drying time, sufficient for guaranteeing treatment of the surface, most frequently between 2 and 5 hours, and even between 2 and 3 hours, at a temperature between 20° C. and 30° C. and average relative humidity between 20 and 70%.

In addition, because the gels according to the invention comprise a viscosing agent or preferably a mixture of viscosing agents, and an active decontamination agent in the aforementioned concentrations, the drying of the gel leads to a dry residue having the capability of being easy released from the support. Thus, no rinsing with water is required and the method does not thereby generate any secondary effluent.

Generally, the gels of the present invention may be described as colloidal solutions comprising one or more generally mineral viscosing agents, such as alumina or silica, and an active treatment agent, for example an acid, a base, an oxidizing agent, a reducing agent, or a mixture thereof, which is notably selected according to the nature of the treatment and of the surface to be treated.

Thus, for a treatment consisting in removing non-fixed contamination, as fats, on stainless and ferritic steel surfaces, an alkaline gel having degreasing properties may be used.

Removal of hot and cold fixed contamination on a stainless steel surface may be performed by means of an oxidizing gel. Dissolution of the oxide layers may be effected by means of a reducing gel which will preferably be used in addition and alternately to the oxidizing gel.

Lastly, a cold fixed contamination on ferritic steel may be removed by means of an acid gel, for example.

The gel may be applied on the surface to be treated with conventional methods such as gun spraying or by means of a brush, for example a decontamination brush.

For applying the gel by spraying it on the surface to be treated, the viscous colloidal solution may be transported via a low pressure pump (<7 bars) for example and the breaking up of the gel jet on the surface may be achieved with a flat or round jet nozzle. The sufficiently short viscosity recovery time enables the sprayed gel to adhere to the wall.

The amounts of gel deposited on the surface to be treated are generally from 100 to 2,000 $g/m^2$, preferably from 100 to 1,000 $g/m^2$, more preferably from 300 to 700 $g/m^2$. They influence the drying time of the gel.

The drying time of the gel of the present invention mainly depends on its composition within the concentration ranges defined above. Generally, it is between 2 and 5 hours, more specifically between 2 and 3 hours, at a temperature between 20° C. and 30° C., and at an average relative humidity between 20 and 70%.

The dry residue obtained after drying may be removed easily, for example by brushing and/or suction, but also by a gas jet, of compressed air, for example.

It is obvious that the treatment of the surface will be renewed every time with the same gel or with gels of different nature during the different successive steps, each of these steps consisting of applying the gel, maintaining the gel on the surface during the treatment of the surface, and drying it, as well as removing the obtained dry residue.

The present invention is generally applied for example to the treatment for decontaminating metal surfaces, whether substantial or not, which are not necessarily horizontal but may be inclined or even vertical.

Under the term treatment, it is understood any surface treatment for cleaning, decontaminating or etching said surface. For example it may be a radioactive or organic decontamination treatment (e.g. removal of microorganisms, of parasites, etc.), an etching treatment for removing oxides or a surface degreasing treatment.

The present invention may be used for treating any kinds of surfaces such as metal surfaces, plastic surfaces, glassy material surfaces, etc.

One skilled in the art will know how to adapt the aforementioned compositions of the gels of the present invention according to the surface to be treated and to the treatment to be carried out.

Advantageously, the present invention may be used for example in the nuclear field, for decontaminating tanks, ventilation shafts, storage pools, glove-boxes, etc. It may also be used within the framework of periodic maintenance of existing facilities, as well as for rehabilitating facilities.

Indeed, it provides limitation of the amount of effluent produced during the treatment of the aforementioned items.

It also finds an application in the treatment of facilities into which it is forbidden to introduce liquid. An example of such an application is the decontamination of ventilation shafts of nuclear facilities.

Accordingly, the present invention also relates to a method for decontaminating a facility.

According to the invention, the decontamination method may consist of removing dust from the facility to be treated, followed by a treatment of the facility by means of a treatment method according to the present invention.

Removal of dust from the facility to be treated may be achieved for example by brushing, blowing, or sucking up dusts so as to remove non-fixed solid contamination. This pretreatment may be performed for example on stainless steel ventilation shafts of nuclear facilities which contain large quantities of dusts.

The treatment method of the present invention may then be used by applying one or more runs of the gel of the invention, in order to remove fixed contamination at the internal walls of shafts. The gels dry completely after having acted on the surface and are easily released from the wall by suction.

Other features and advantages of the invention will further become apparent upon reading the following examples, with reference to the appended drawings, naturally given by way of illustration and in a non-limiting way.

In these figures, Te represents the evaporation rate as a percentage of the initial amount of solvent, ts: the drying time in minutes, T: the drying temperatures for each curve in ° C., and Hr the relative humidity rate during the different tests, expressed at a percentage.

EXAMPLES

Example 1

The drying properties of a gel based on AEROSIL 380 silica, a pyrogenated silica with a high surface area of 380 $m^2/g$, are studied in this example.

Preliminary tests performed by the inventors were able to show that in a concentrated nitric medium 7 M, by using a formulation based on pyrogenated silica, for example of the AEROSIL 380 (trade name) type at a concentration between 8 and 10% by weight, dry residues may be obtained which are easily released after a few hours (between about 2 and 5 hours). Thus, the contact times are sufficient for treating a surface. A silica content of the order of 8% by mass was therefore retained by the inventors.

The amount of gel deposited on the surface had only a slight influence on the drying features and more particularly on the release capability. Various amounts of gel ranging from 0.1 to 2 kg per $m^2$ were deposited on surfaces. The amounts from about 0.3 $kg/m^2$ to 0.7 $kg/m^2$ are preferred.

The drying conditions are the most significant parameters in the method of the present invention. The drying temperature and the humidity rate of the drying air are found among them. The existence of a convective current is also significant. The influence of these parameters was quantitatively appreciated by plotting drying abaci.

The retained temperature range is from 20° C. to 30° C. and the relative humidity range of the drying air is from 20% to 70%, wherein relative humidity is defined at the ratio of the steam pressure at a given temperature to the saturating steam pressure at the same temperature.

New 304 L stainless steel parts are coated with gel. The deposited amount of gel is 0.5 $kg/m^2$ (±5%) for the following tests when this is not specified.

The silicas are pre-mixed in a cylindrical beaker at 800 rpm by a propeller mixer in order to ensure intimate mixing of the silicas. During the preparation, the gel is stirred at 500 rpm by the same stirring system.

The coated samples are placed in a weathering chamber with controlled temperature and humidity. The weathering chamber is of the trade name KBF and has a volume of 115 liters. Humidity control is provided by injection of steam generated by the passing of an electrical current in the humidifier. The velocity of the convective current at the surface of the samples may be considered as identical for all the cases and of very low intensity. The coating mass is tracked for each fixed temperature/humidity pair.

1st) Influence of Temperature

Figure 1:
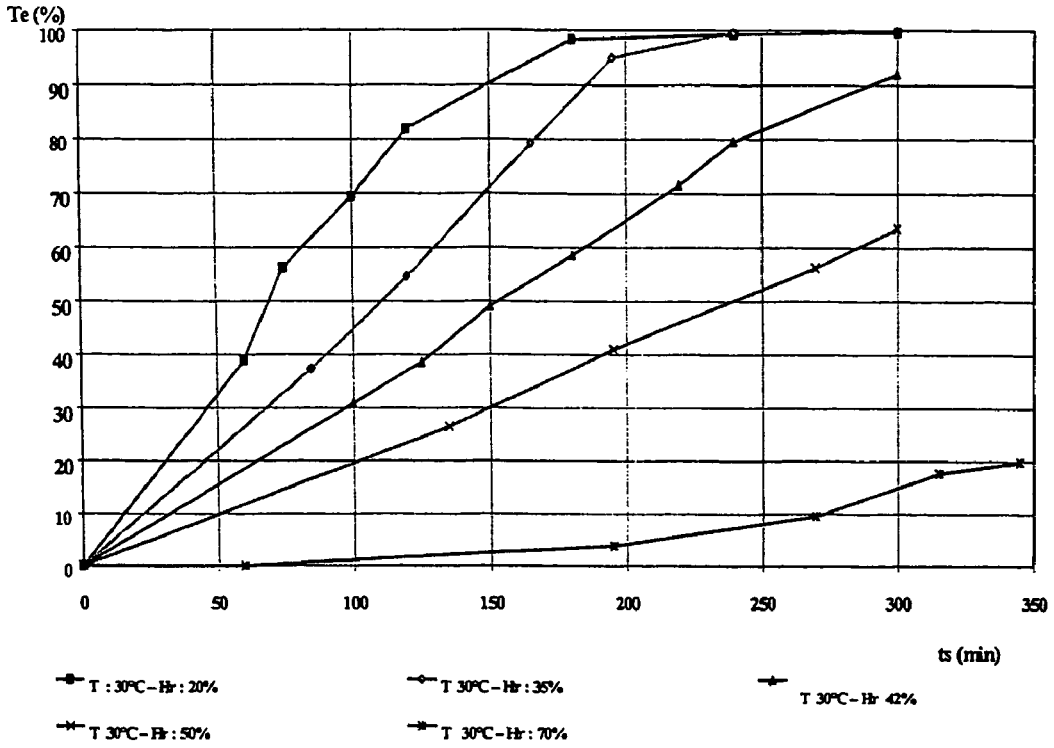
FIG. 1 illustrates drying abaci of a gel according to the present invention at 30° C. versus relative humidity, this gel having a formulation of 8% Aerosil 380 (trade name)+$HNO_3$ 7 M.
Figure 2:
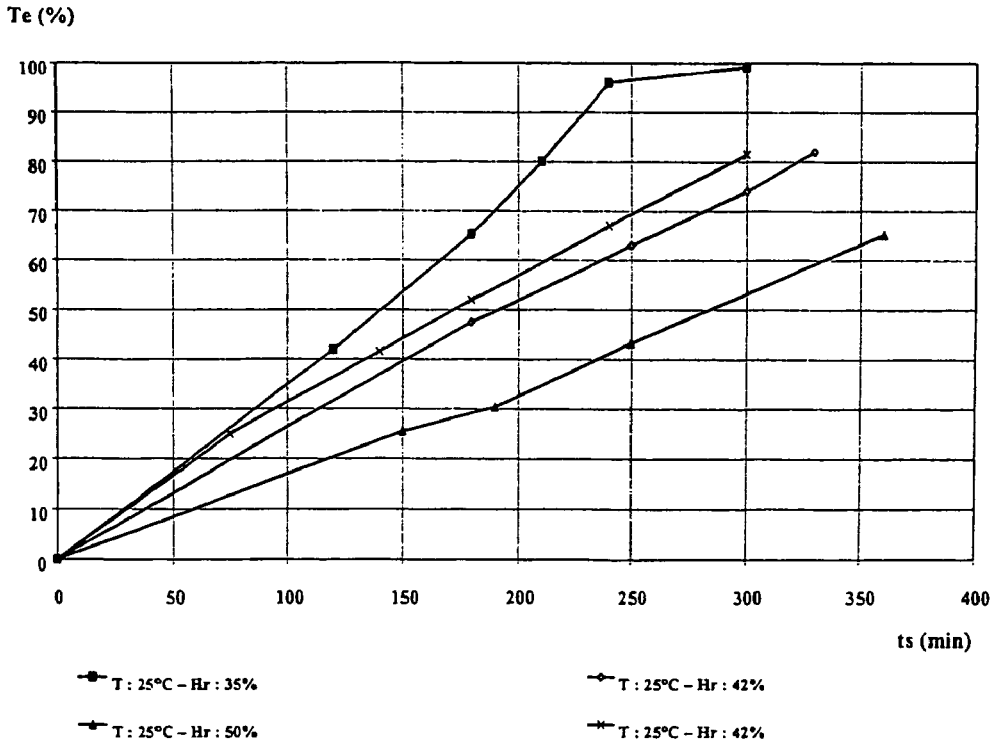
FIG. 2 illustrates drying abaci of a gel of the present invention at 25° C. versus relative humidity, this gel having a formulation of 8% Aerosil 380 (trade name)+$HNO_3$ 7 M (on the -x- curve: T: 25° C.–$H_2$: 42% only SiO38).
Figure 3:
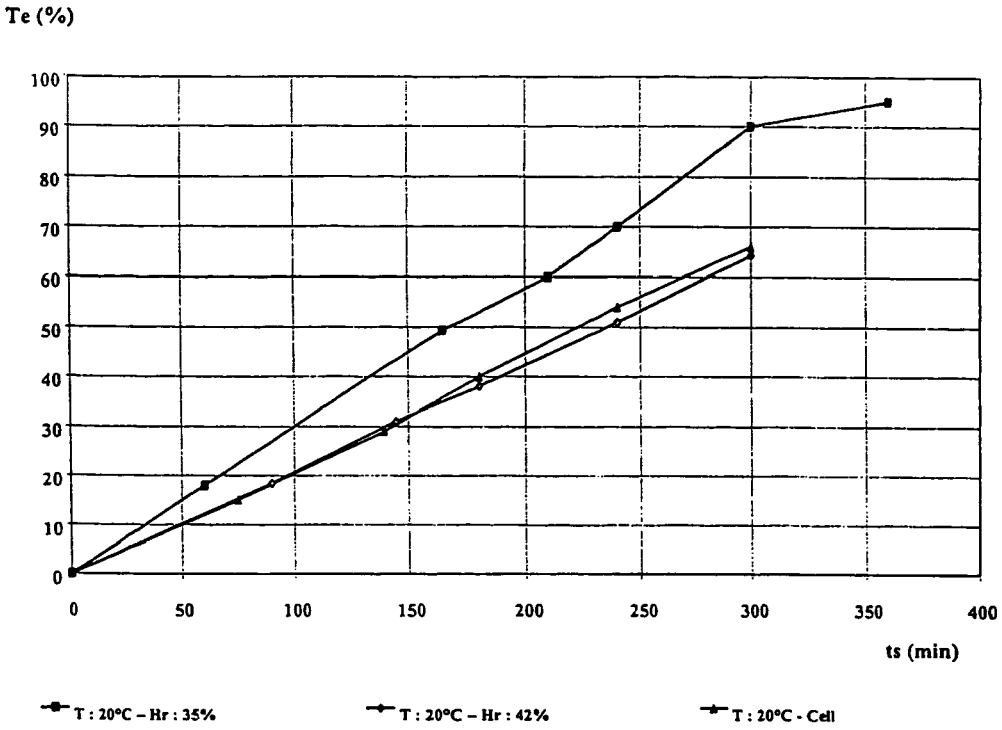
FIG. 3 illustrates drying abaci of a gel of the present invention at 20° C. versus relative humidity, this gel having a formulation of 8% Aerosil 380 (trade name)+$HNO_3$ 7 M.

For three temperatures 30° C., 25° C., and 20° C., the abaci depicted on FIGS. 1 to 3 were plotted for several values of the relative humidity.

The curves corresponding to abaci at 30° C. are shown in FIG. 1.

The curves obtained in this figure show a linear portion corresponding to the constant drying rate phase. The drying rate is all the slower as the humidity is higher, which is consistent. For low humidities (20% and 35%), the occurrence of a plateau from about 200 minutes is noted. This plateau corresponds to 100% of evaporated solvent which indicates that the drying phase with a decreasing rate is quasi non-existent. From this, it is inferred that the gel is completely dry after about three hours, as soon as the humidity is less than 35%. On the other hand, for larger values, the plateau is not reached after the experiment time. It may be obtained by extrapolating the initial constant rate drying phase. Under these conditions, it is seen that in the absence of any convective current, 50% humidity leads to an extrapolated drying time of about 8 hours, which remains compatible with a decontamination operation. A relative humidity greater than 70% in this case leads to excessive drying times.

The curves corresponding to the abaci at 25° C. are shown in FIG. 2. The test at 70% relative humidity was suppressed after taking into account the longer drying times observed at 30° C.

The obtained curves have the same aspect than at 30° C. However, the drying times are extended. Complete drying is obtained at 35% humidity within a period of the order of 5 hours. Taking into account the test performed at 30° C., it is determined by extrapolation that with 20% relative humidity, the total drying time for this value at 25° C. is between 3 hours and 5 hours. At 50% humidity, the extrapolated total drying time is 9 hours, which remains acceptable in a surface treatment method.

By means of the following tests, a practical value was able to be inferred for a shielded cell atmosphere. A drying abacus was plotted in a shielded cell of trade name DEMETER, the temperature of the air of the cell was 22° C. The curves corresponding to this test as well as others achieved at 20° C. in the weathering chamber are shown in the appended FIG. 3. In this figure, reference "Cell" represents the DEMETER cell (trade name).

The test conducted in the DEMETER cell is superimposed with the test performed at 42% relative humidity in the weathering chamber, With this, a pair of representative values of the atmosphere of a shielded cell, i.e. about 20° C. and 42% relative humidity, may be derived. This analogy does not take into account any possible deviation of the convection between the weathering chamber and the shielded cell.

As for the total drying time at 20° C., taking into account the experimental results, it was estimated to be about 7 hours at 35% humidity and at about 8 hours at 42% humidity.

2nd) Influence of the Applied Amount of Get

Figure 4:
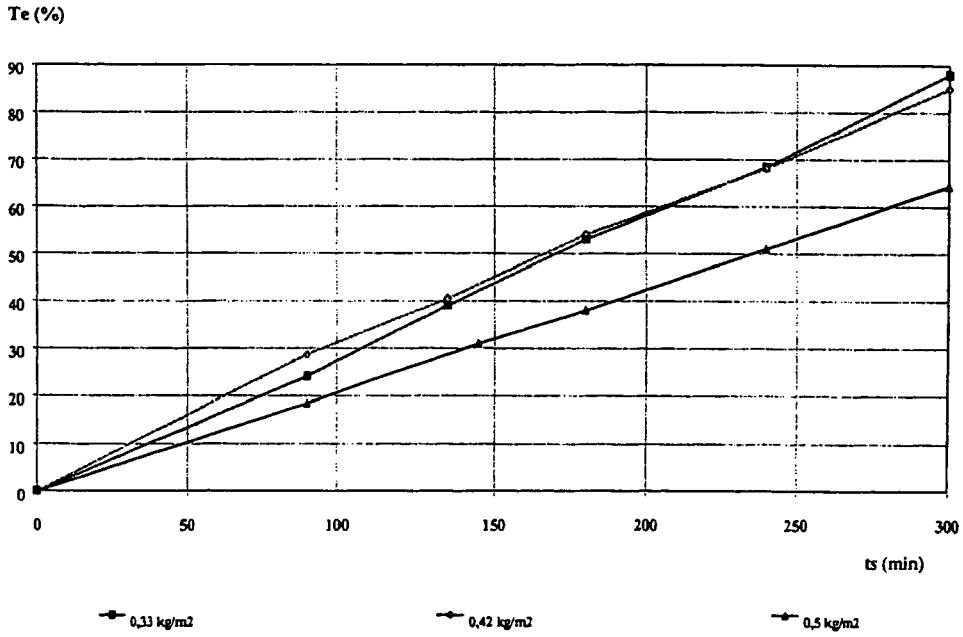
FIG. 4 illustrates drying abaci of a gel of the present invention at 20° C. and at 40% relative humidity, versus the amount of gel applied on the surface, this gel having a formulation of 8% Aerosil 380 (trade name)+$HNO_3$ 7 M.

The appended FIG. 4 assembles curves achieved for three deposited amounts of gel at 20° C. and at 42% relative humidity.

This figure shows that drying kinetics is affected very little between 0.33 kg/m$^2$ and 0.42 kg/m$^2$ of deposited gel. A sharper difference is visible for 0.5 kg/m$^2$. Under these conditions, it therefore seems preferable to aim at relatively low application rates of the order of 0.3 kg/m$^2$.

3rd) Influence of Humidity of Drying Kinetics

Figure 5:
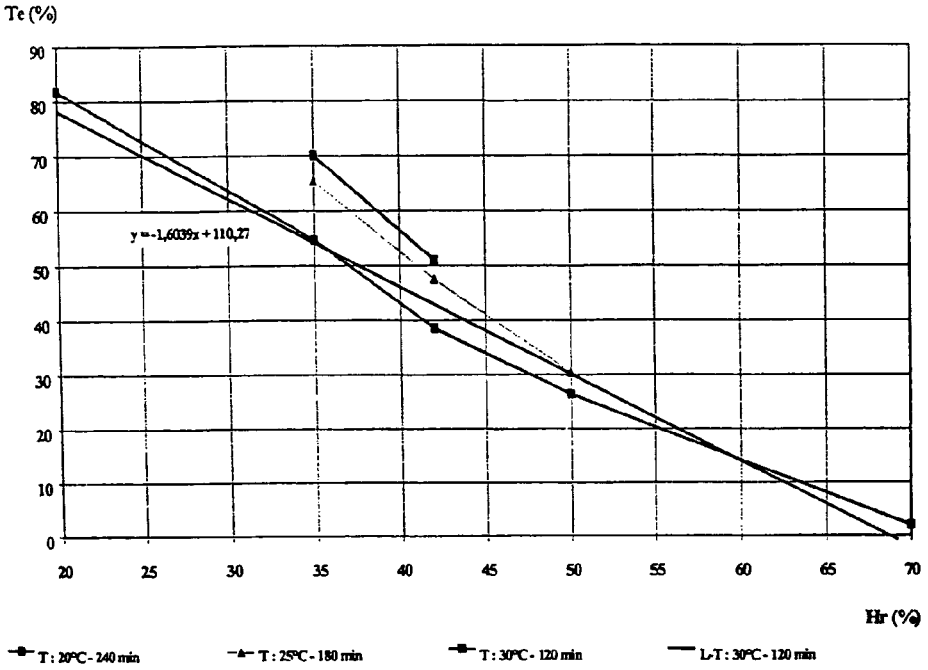
FIG. 5 is a graph illustrating the influence of the humidity rate on the drying kinetics at different drying temperatures of a gel according to the invention, this gel having a formulation of 8% Aerosil 380 (trade name)+$HNO_3$ 7 M.

In order to assess incidence of humidity, curves were plotted from the characteristic points of the constant rate drying phases of the gel, observed during the previous test conducted at a fixed temperature. These curves are shown in the appended FIG. 5. In this figure, "L" represents a drying line at 30° C. for 120 minutes, plotted from the average values of the corresponding curves. This line has the equation $y=-1.6039x+110.27$, with x the relative humidity in %, and y the evaporation rate (% of the initial amount of solvent).

The characteristic times having been selected in the constant rate drying range, for a given temperature, the humidity rates plotted as ordinates change in proportion with the drying rate. On the other hand, it is impossible to compare one temperature with the other as the retained times are not identical for all the temperatures.

This figure shows that the drying rate is reduced linearly when the relative humidity rate increases for all the temperatures, in the experimental range. Influence of the humidity rate tends to increase slightly when the temperature is reduced, which is consistent.

The increase in humidity by 10% is expressed by a reduction in the drying rate by 16%. This shows the importance of being well aware of the drying conditions when applying the gel in the method of the present invention.

4th) Influence of Temperature on Drying Kinetics

Figure 6:
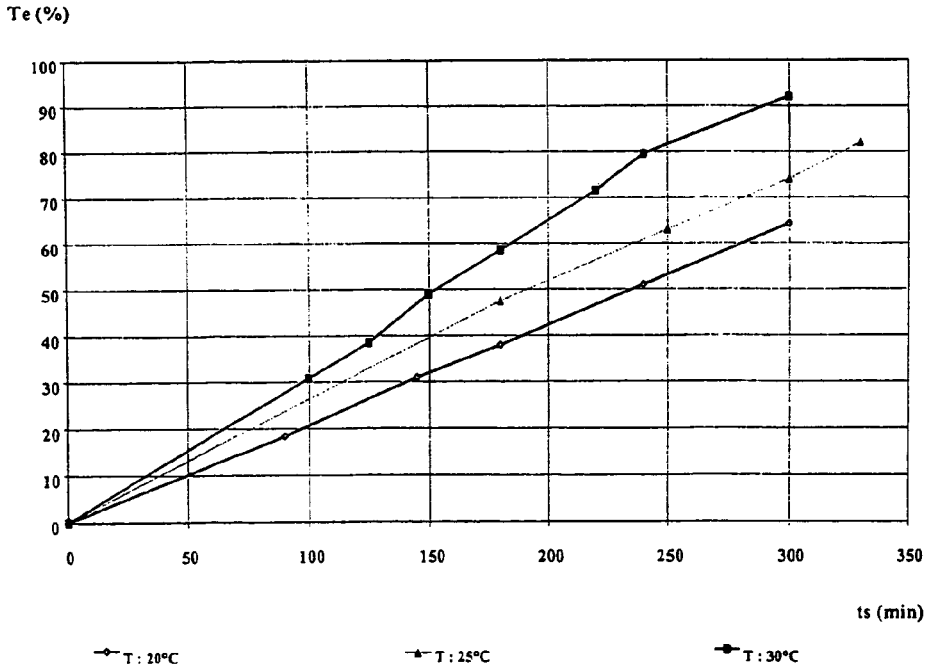
FIG. 6 is a graph illustrating the influence of the temperature on the drying kinetics of a gel according to the invention, at 42% relative humidity, this gel having a formulation of 8% Aerosil 380 (trade name)+$HNO_3$ 7 M.

For tests performed at 42% relative humidity, a comparison of the kinetics is made at different temperatures. The results are plotted in FIG. 6.

As previously, it may be assessed that the increase in temperature by 10% leads to an increase in the drying rate by about 13%. The contrary effects of increase of humidity and temperature are therefore recorded.

With the drying abaci established in this example, the required drying times may be predicted upon applying the method of the present invention, provided that the temperature of the air in the shaft and its relative humidity are known.

The representative range of the atmosphere of a shielded cell was estimated to be centered around the following values: temperature: 20° C. and relative humidity: 40%. These values were obtained by analogy while carrying out a drying test in the DEMETER (trade name) cell.

As regards compatibility of the drying times with a decontamination operation, the abaci show good compatibility as soon as the temperature is above 20° C. and the humidity is less than about 40%. For lower temperatures or higher humidity, it may be necessary to set up a convective state in the shaft which may be achieved by operating at half the rate.

Example 2

In this example, the drying properties of a gel based on a mixture of silicas comprising 8% by weight of AEROSIL 380 (trade name) which is a pyrogenated silica with a high surface area of 380 m$^2$/g, and from 0.5% to 1% in weight of FK310 (trade name) precipitated silica.

The size of the obtained residues after drying in the case of the Aerosil 3080 (trade name) and FK3 10 mixture, was compared with the size of the residues collected in the case of Aerosil 380 (trade name) silica alone.

Figure 7:
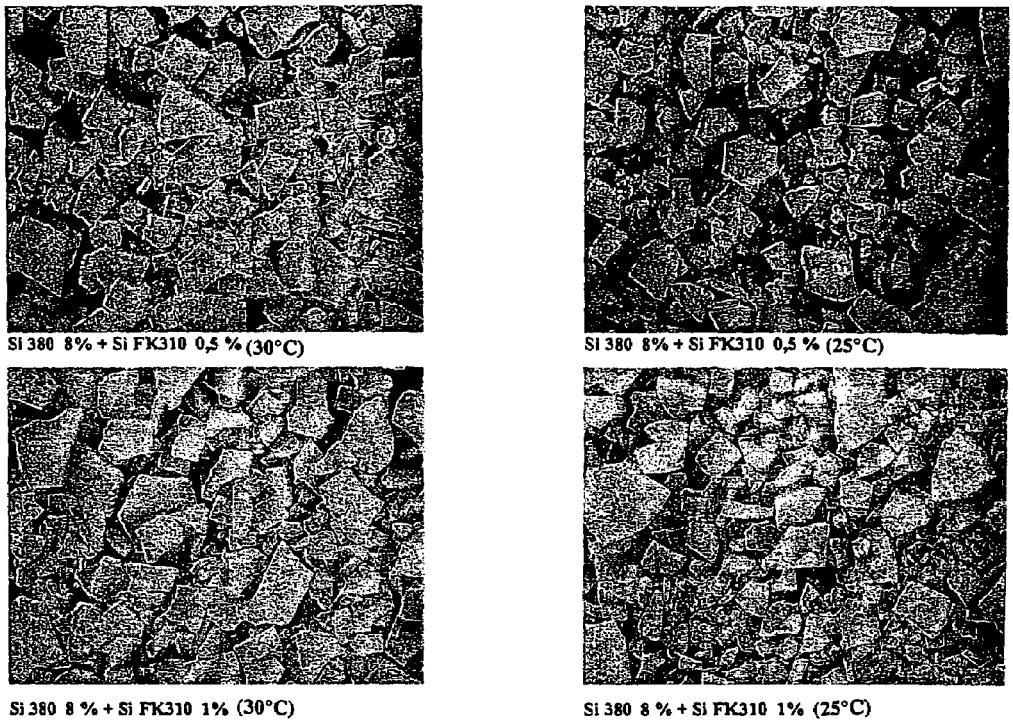
FIG. 7 shows four photographs showing dry residues of gel obtained with the mixture of 8% Aerosil 380 (trade name) and 0.5% FK310 (trade name), on the one hand, and with the mixture of 8% Aerosil 380 (trade name) and 1% FK310 (trade name) on the other hand, for two drying modes.
Figure 8:
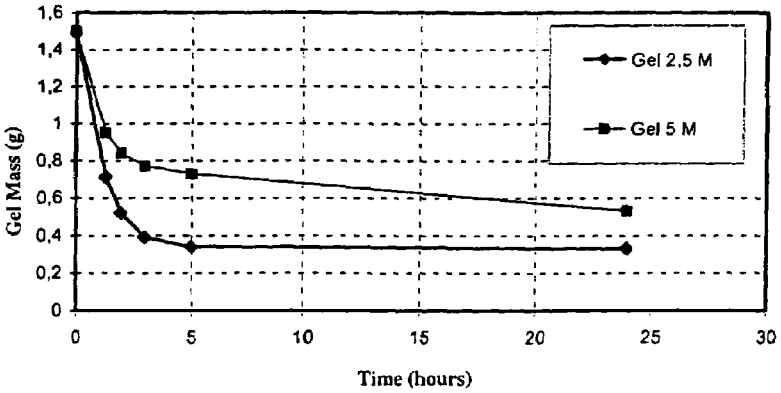
FIG. 8 is a graph illustrating the loss of mass of two alumina gels at 2.5 and 5 mol/l of caustic soda versus time (M=mass and t=time).

In the appended FIG. 7, photographs of dry residues obtained with the 8% Aerosil 380 (trade name) and 0.5% FK310 (trade name) mixture referenced as "A" on the one hand, and with the 8% Aerosil 380 (trade name) and 1% FK310 (trade name) mixture, referenced as "B", on the other hand, are shown for two drying modes, one at 30° C. and the other at room temperature (25° C.).

These results show that the size of the dry residues depends very little on the drying conditions, which is an advantage. As regards the size of the residues, it is observed in all cases that it is much larger than the one obtained in the case of Aerosil 380 silica alone. Here, the size of the largest residues is more than a millimeter against $600.10^{-6}$ m in the case of Aerosil 380 (trade name) silica alone. The proportion of residues with large dimensions is much more significant. In the same way, there are much less residues of very small dimensions which may not be carried away upon removing the dry residues. Without performing an accurate quantitative analysis on the grain size distributions, an order of magnitude from 2 to 3 may be put forward for the increase in the average size of the dry residues, which. is dramatic considering the small amount of added silica. The result is observed as soon as 0.5% of FK310 (trade name) silica is added.

This result is very significant as it shows that the present invention provides a gel having features close to those of a conventional decontamination gel as long as it is not dry in terms of contact times and composition. On the other hand, when the gel is dry, its residues have a controlled size relatively independently of the drying features thanks to the addition of precipitated silica. The advantages are notably the absence of pulverulent residue, the obtained sizes are of the order of 0.1 to 3 mm, facilitating releasability of the residue from the surface, and recovery by brushing or suction.

Example 3

The viscosing agent used in this example for preparing alkaline gels is alumina. This is aluminum oxide $Al_2O_3$ provided by DEGUSSA and for which the primary particle size is around 13 nanometers and the BET surface area is 100 $m^2/g$.

An amount of 15 g of alumina is poured into 100 ml of water or into 100 ml of a caustic soda solution with a determined concentration. The solution is stirred by a mechanical stirrer provided with a three blade stirrer at a speed of 600 to 800 rpm for 2 to 3 minutes. The obtained gel is homogeneous and may be sprayed with a low pressure pump marketed by FEVDI. With an amount of 15 g of alumina for 100 ml of solution, a viscosity may be obtained which allows spraying at low pressure (<7 bars) and this ensures a significant contact time with the wall as the gel does not run down on a vertical wall.

Four gels were prepared by varying the soda concentration between 0.5 and 5 M.

Each gel is spread with a spatula uniformly over a new stainless steel 304 L (trade name) plate of 5 cm×6 cm dimensions. The mass of deposited gel is controlled by weighing and is set to 500 $g/m^2$. The plate is then put into an oven to dry at 22° C.±1° C. in the presence of a substantial convective air current. Relative humidity is controlled and set to a value of 42±1%, estimated as representative of the humidity conditions encountered in ventilation shafts of nuclear facilities.

The loss of gel mass during the evaporation of the solvent (water) is then tracked over time.

The mass of the two gels with the highest soda concentrations, i.e. 2.5 and 5 M, is tracked over time. The initial mass of the deposited gel is 1.5 g, i.e. about 220 mg of dry alumina.

The two gels with the highest soda concentrations, i.e. 2.5 and 5 M, do not dry. The mass loss of the gel 2.5 M reaches a plateau after 5 hours and the gel mass is stabilized around 330 mg after 24 h. The gel still contains water and remains adhered to the steel plate. The gel with the highest concentration 5 M, continues to lose mass after 24 h and the gel still contains more water than the 2.5 M gel.

Therefore, both of these gels cannot be used for the contemplated application as they do not dry rapidly at a temperature between 20° C. and 30° C. and do not fall off the support.

On the other hand, the 0.5 M soda gel dries within 75 minutes, and the residue is entirely released from the plate at the slightest mechanical stress. The 1 M soda gel dries within 2 hours and is also released very easily. It is therefore necessary to reduce the amount of soda so that the water evaporates sufficiently in order to obtain a residue which is released from the support.

Hence, a concentration of 1 to 2 mol/l is often preferred: this leads to a gel which dries relatively rapidly, i.e. within 2 to 3 hours, and which is released very easily from the steel support at the slightest stress.

The efficiency of the gel deposited on a surface coated with DELASCO (trade name) pump grease, with moderately viscous silicone grease, or with a more fluid grease for lubrifying Cardan joints called G 12, is substantial, since 75 to 90% of the grease is removed from the support. The dry gel is easily released patchwise at the slightest jolt and therefore it may easily be removed by suction again.

Example 4

For decontaminating aluminum, gels based on 8 wt % of AEROSIL 380 (trade name) silica and a mixture of nitric acid and phosphoric acid, were prepared. The concentration of each of both acids is preferably less than 2 mol/l. Beyond this value, the gel does not dry at a temperature of 25° C. and at 40% relative humidity. For a concentration of each of both acids between 1 and 2 M, drying times observed at a temperature of 25° C. and at 40% relative humidity vary between 2 and 4 hours.

A gel ($HNO_3$ 1M/$H_3PO_4$1 M) was notably prepared and tested in terms of decontamination on aluminum flanges from a pneumatic transfer network of a nuclear waste reprocessing plant. Decontamination factors of the order of 14 (Cs 137, Eu 154) were obtained after a single fun of gel (Cs 137: from 1,300 $Bq/Cm^2$ to 110 $Bq/cm^2$) and surface activity could be lowered to below 50 $Bq/cm^2$ with an extra run.

Example 5

For decontaminating stainless steel or inconel (trade name), an oxidizing gel according to the invention was prepared by using 3 M nitric acid and 0.1 to 0.3 M of Ce(IV).

The gels dry rapidly in less than 3 hours, and are easily released with a brush. The corrosion results obtained by coating 500 $g/m^2$ on inconel are quite interesting as the generalized erosion is actually between 0.1 and 0.3 μm.

The invention claimed is:

1. A gel for treating a radioactive surface consisting of a colloidal aqueous solution consisting:

5 to 25% by weight, based on the weight of a gel, of a mixture of pyrogenated silica and precipitated silica, the pyrogenated silica representing 8% by weight of the gel, the precipitated silica representing 0.5% to 1% by weight of the gel, 0.5 to 4 mol/l of an active treatment agent, wherein the active treatment agent is selected from a group consisting of acids, bases, and mixtures thereof, water, and optionally 0.05 to 1 mol/l of an oxidizing agent with a normal oxidation-reduction potential $E_0$ larger than 1.4 V in a strong acid medium or of the reduced form of this oxidizing agent, wherein said gel forms a solid, dry residue having a particle size in the range from 0.1 to 3 mm in size.

2. The gel according to claim 1, wherein the silica mixture represents 5 to 15% by weight based on the weight of the gel: and wherein the active treatment agent is an inorganic acid or a mixture of inorganic acids.

3. The gel according to claim 1, wherein the mixture of pyrogenated and precipitated silicas represents 5 to 10% by weight of the gel.

4. The gel according to claim 1, wherein the oxidizing agent with a normal oxidation-reduction potential $E_0$ larger than 1.4 V in a strong acid medium is selected from Ce(IV), Co(III) or Ag(II).

5. The gel according to claim 1, wherein said gel is in an amount from 100 to 1,000 $g/m^2$.

6. The gel according to claim 1, wherein said gel is in an amount from 300 to 700 $g/m^2$.

7. The gel according to claim 1, wherein said gel is in an amount from 500 to 700 $g/m^2$.

8. The gel according to claim 2, wherein the inorganic acid is selected from hydrochloric acid, nitric acid, sulfuric acid, phosphoric acid or a mixture thereof.

9. A gel for treating a radioactive surface consisting of a colloidal aqueous solution consisting:

5 to 25% by weight, based on the weight of a gel, of an inorganic viscosing agent consisting of silica, 0.5 to 4 mol/l of an active treatment agent, wherein the active treatment agent is selected from a group consisting of acids, bases, and mixtures thereof, water, and optionally 0.05 to 1 mol/l of an oxidizing agent with a normal oxidation-reduction potential $E_0$ larger than 1.4 V in a strong acid medium or of the reduced form of this oxidizing agent, wherein said gel forms a solid, dry residue having a particle size in the range from 0.1 to 3 mm in size.

10. The gel according to claim 9, wherein said silica represents 5 to 15% by weight of the gel.

11. The gel according to claim 9, wherein the silica is a mixture of pyrogenated silica and precipitated silica, the mixture representing 5 to 15% by weight of the gel.

12. The gel according to claim 9, wherein the silica is a mixture of pyrogenated silica and precipitated silica, the precipitated silica representing about 0.5% by weight of the gel, and the pyrogenated silica representing 8% by weight of the gel.

13. The gel according to claim 9, wherein the active treatment agent is an inorganic acid or a mixture of inorganic acids.

14. The gel according to claim 9, wherein the active treatment agent is an inorganic base present in a concentration from 0.5 to 2 moles per liter of gel.

15. The gel according to claim 9, wherein the oxidizing agent is in a concentration of 0.5 to 1 mol/l with a normal oxidation-reduction potential $E_0$ larger than about 1.4 V in a strong acid medium selected from Ce(IV), Co(III), or Ag(II).

16. The gel according to claim 9, wherein the dry and solid residue is removable from the treated surface by brushing or suction.

17. The gel according to claim 10, wherein the silica is pyrogenated silica, precipitated silica, or a mixture of pyrogenated silica and precipitated silica.

18. The gel according to claim 9, wherein the active treatment agent is nitric acid in a concentration from 0.5 to 2 mol/l of gel and the oxidizing agent is $Ce(NO_3)_4$ or $(NH_4)_2Ce(NO_3)_6$ in a concentration of 0.1 to 0.5 mol/l of gel.

19. The gel according to claim 13, wherein the inorganic acid is selected from hydrochloric acid, nitric acid, sulfuric acid, phosphoric acid or a mixture thereof.

20. The gel according claim 14, wherein the inorganic base is selected from soda, potash or a mixture thereof.

* * * * *